United States Patent [19]

Luke

[11] 4,186,518

[45] Feb. 5, 1980

[54] KICKING DOLL WITH DETACHABLE TRIGGER MEANS

[75] Inventor: Patrick Luke, Kowloon, Hong Kong

[73] Assignee: Mego Corporation, New York, N.Y.

[21] Appl. No.: 844,643

[22] Filed: Oct. 25, 1977

[51] Int. Cl.[2] ..... A63H 13/04

[52] U.S. Cl. ..... 46/128; 46/148

[58] Field of Search ..... 46/126, 128, 142, 143, 46/148; 273/85 E, 85 F

[56] References Cited

U.S. PATENT DOCUMENTS

| | | | |
|---|---|---|---|
| 1,633,456 | 6/1927 | Norberg | 46/128 |
| 2,638,348 | 5/1953 | Arenson et al. | 46/148 X |
| 2,799,501 | 7/1957 | Barbolla | 273/85 F |
| 3,852,911 | 12/1974 | Sapkus et al. | 46/126 |
| 3,874,112 | 4/1975 | Sapkus et al. | 46/128 X |
| 3,927,883 | 12/1975 | Bosley | 46/142 |

*Primary Examiner*—F. Barry Shay

*Attorney, Agent, or Firm*—Bertram Frank

[57] ABSTRACT

A doll with an intermittently movable limb, e.g. a leg that kicks when a trigger is pressed in simulation of a soccer player. The doll has a hollow torso and the limb extends from the torso. A toothed rack and at least one gear are mounted in the torso, with the gear being geared to the rack. The axle of the gear is connected to the limb at a pivot point, so that when the gear is partially rotated by motion of the rack, the limb, e.g. a leg, partially pivots about the pivot point, i.e. the leg kicks. External trigger means are provided to displace the rack within the torso transversely to the axis of the gear so that the gear is partially rotated.

8 Claims, 12 Drawing Figures

FIG. 1
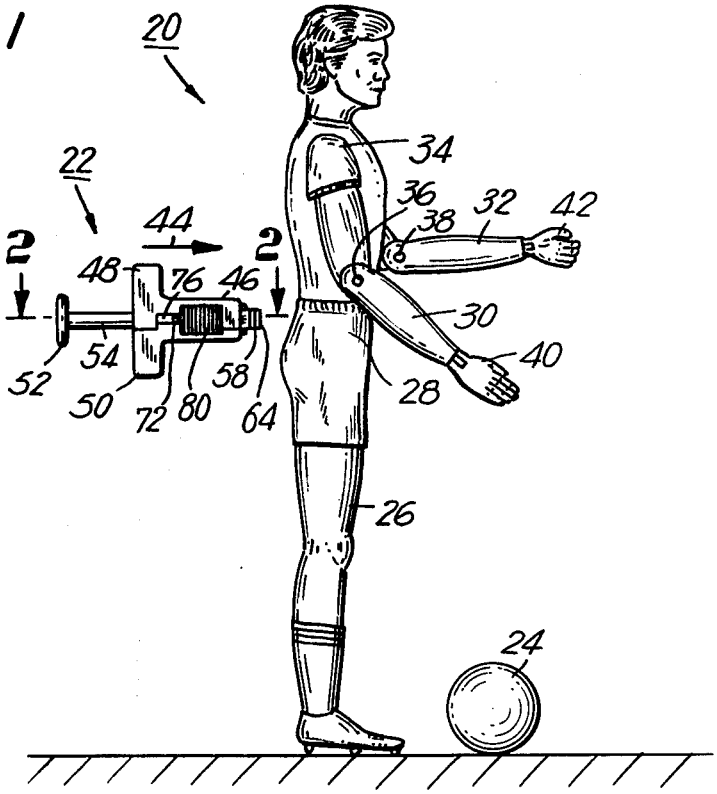
FIG. 2
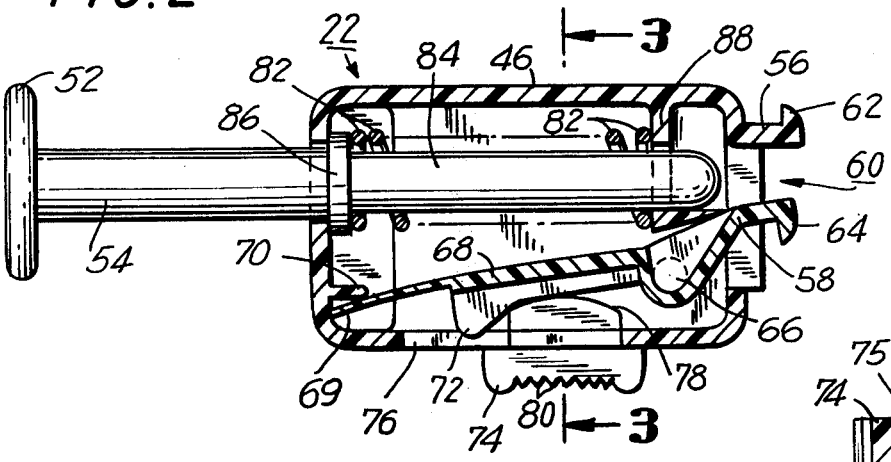
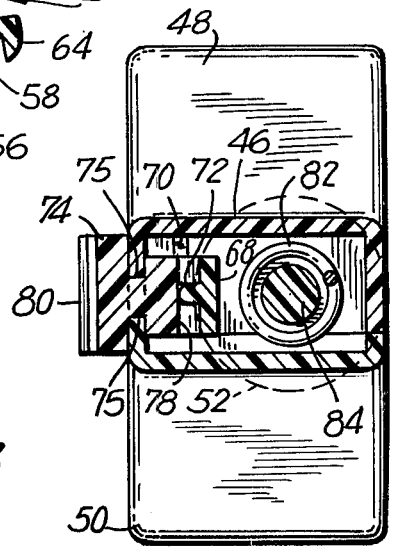
FIG. 3

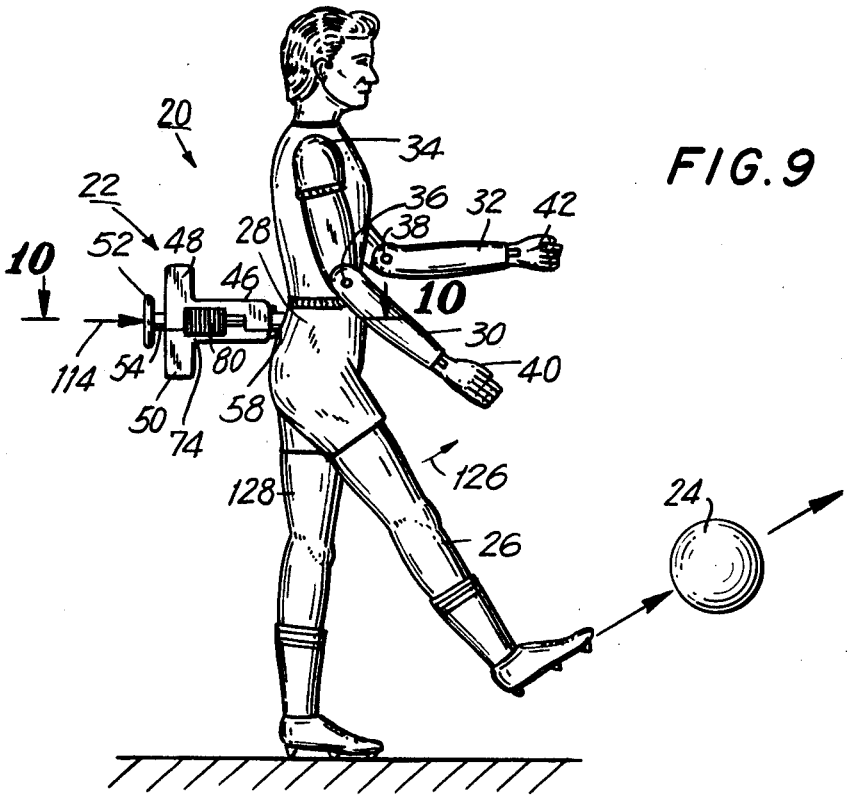
FIG. 9
FIG. 10
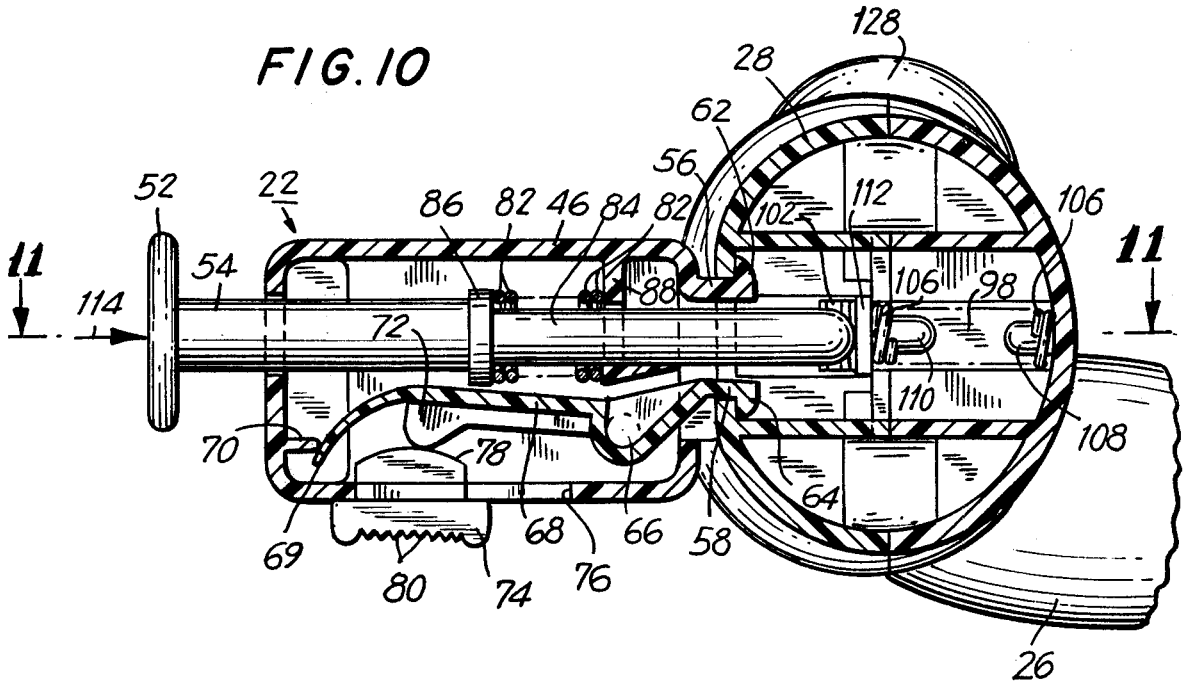

FIG. 11
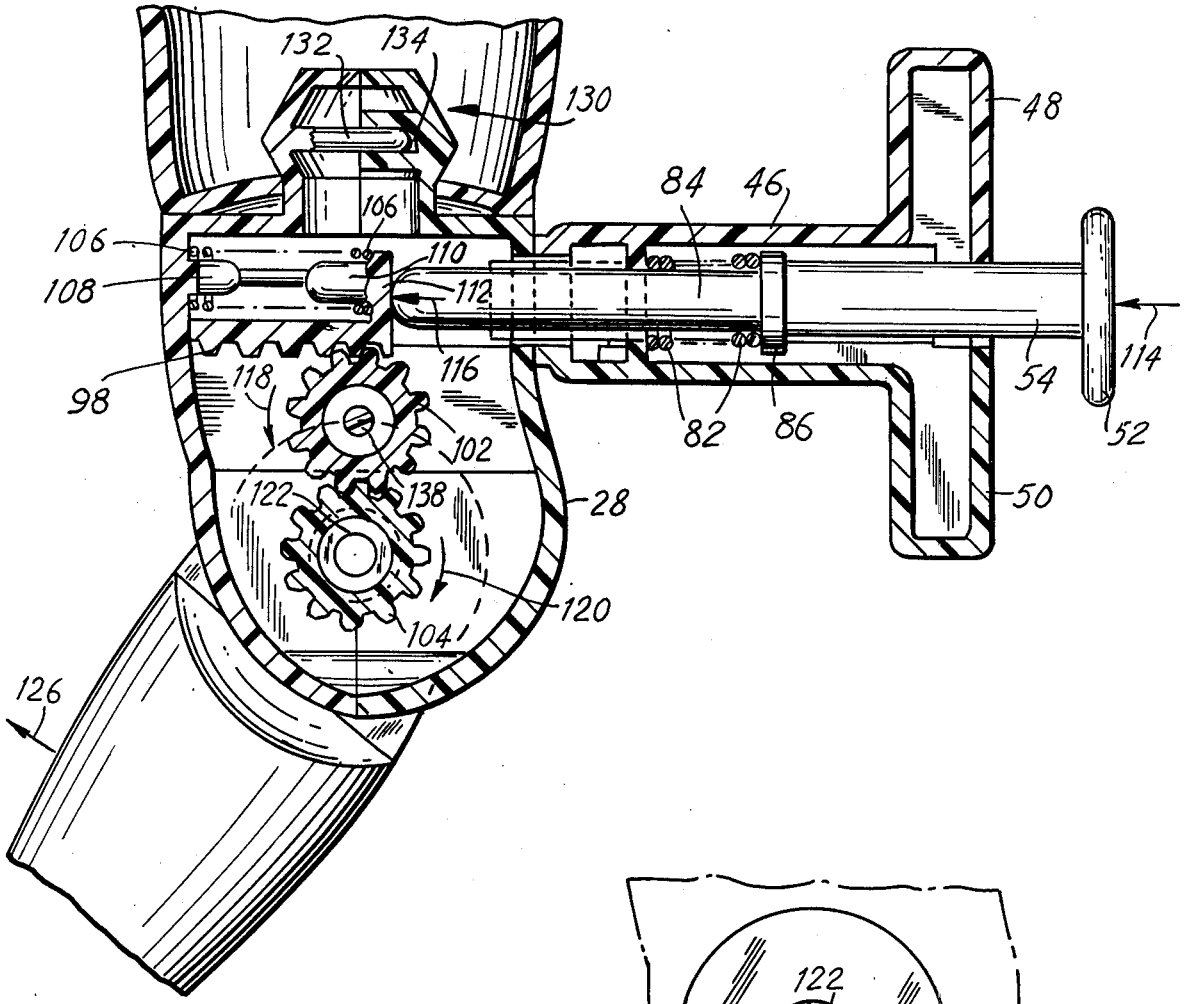
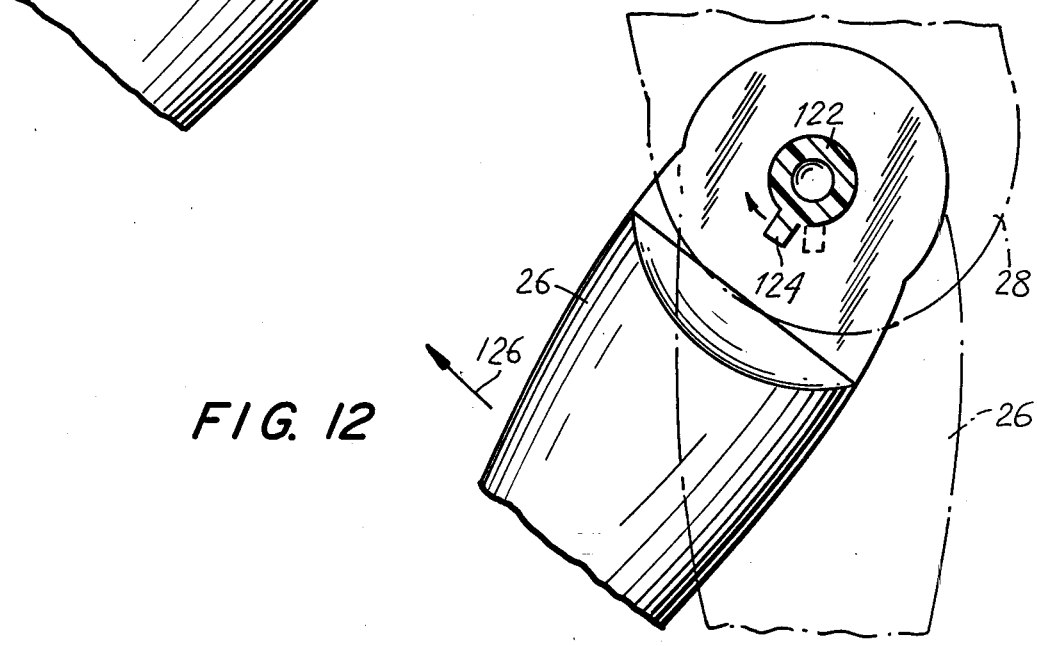
FIG. 12

KICKING DOLL WITH DETACHABLE TRIGGER MEANS

BACKGROUND OF THE INVENTION

1. Field of the Invention

A doll with intermittently movable limb.

2. Description of the Prior Art

Action dolls and motion dolls provide a great deal of enjoyment for children, especially for older children who can readily relate to the field of activity of the doll. Thus, an action doll simulating a prize fighter has been disclosed in U.S. Pat. No. 4,003,158. Other action dolls simulating baseball or football players, tennis or golf players etc. have been developed or proposed in the prior art. The game of soccer has gained wide popularity in recent years, however up to the present a doll with a kicking leg action simulating a soccer player has not been devised in the art of action dolls.

SUMMARY OF THE INVENTION

1. Purposes of the Invention

It is an object of the present invention to provide an improved action doll.

Another object is to provide an improved doll with intermittently movable limb.

A further object is to provide a kicking doll in which the leg kicking action is initiated by an external detachably attachable trigger. An additional object is to provide a motion doll which simulates real life movement of a limb.

Still another object is to provide an action doll which can be used to propel a projectile by motion of a limb.

Still a further object is to provide a doll which simulates the kicking motion of a soccer player.

An object is to provide a doll with improved motion of a limb actuated externally to the doll.

An object is to provide a motion doll with improved internal structure to permit intermittent movement of a limb.

These and other objects and advantages of the present invention will become evident from the description which follows.

2. Brief Description of the Invention

In the present invention, the improved doll is provided with an intermittently movable limb, especially one which simulates the kicking leg action of a soccer player. The structure of the doll is characterized by the provision of a torso and at least one limb, e.g. a leg, with the limb extending from the torso. At least a portion of the torso is hollow. A toothed rack and at least one main gear are mounted in the torso; the main gear is geared to the rack. The axle of the main gear is connected to the limb at a pivot point, so that when the main gear is partially rotated by motion of the rack transversely to the axis of the main gear, the limb partially pivots about the pivot point. Means such as a shaft extending external to the doll through an opening in the torso are provided to displace the rack within the torso transversely to the axis of the main gear, in order to accomplish the partial pivoting of the limb.

In a preferred embodiment, the rack is biased by resilient means such as spring means, so that when the displacement means, e.g. the shaft, is spaced away from the rack, the limb returns to its former position relative to the torso. As mentioned supra, the rack is typically displaced by shaft means. In this case the torso of the doll is provided with an opening, with the shaft means extending internally into the torso from an external point through the opening. The shaft means is typically mounted to the doll in trigger means so that when motion of the shaft means is manually triggered, the limb moves about the pivot point. Preferably, the rack is biased by first spring means and the shaft means is biased in the trigger means by second spring means, so that the shaft means tends to be displaced away from the rack unless manipulated towards the torso, and so that when the shaft means is spaced away from the rack, the rack returns to a former position in the torso and the limb returns to its former position relative to the torso.

Typically the shaft means is detachably mounted to the doll in the trigger means by detachably attaching the trigger means to the doll. In a preferred embodiment, the detachable attachment of the trigger means to the doll is accomplished by providing a trigger means comprising a housing having two opposed hook members on opposite sides of an opening in the housing. Each of the hook members has an outer lateral lip. One of the hook members is a rigid member mounted integral to the housing. The other of the hook members is pivotally attached to a resilient lever having a lateral intermediate shoulder. An outer camming button on the housing is juxtaposed with the shoulder, so that displacement of the button away from the other hook cams the lever into an arcuate disposition under tension, so that the other hook is displaced away from the one hook and the housing is locked to the doll with the lips within the opening in the doll. The lever is held in an arcuate disposition by providing a curved camming surface on the button. The shaft means extends from the interior of the housing through both the opening in the housing and the opening in the doll.

In a preferred embodiment, an intermediate pinion gear is provided between the main gear and the rack, with the main gear being geared to the rack by the intermediate pinion gear, so that motion of the rack in one direction relative to the torso partially rotates the intermediate pinion gear, and the partial rotation of the intermediate pinion gear causes partial rotation of the main gear.

As mentioned supra, the limb is preferably a leg of the doll. Thus motion of the limb typically simulates a kicking action of a leg, typically to displace an object external to the doll, e.g. a spherical object simulating a soccer ball which is being kicked by a doll simulating a soccer player in a soccer game.

Generally the axle of the main gear is connected to the limb by any suitable means or configuration of connector. Typically the connection is accomplished by providing a key at an end of the axle, which axle end fits into the limb, together with a keyway in the limb at the junction between the axle end and the limb, with the key extending into the keyway.

The present doll provides several salient advantages. The doll is attractive for a child to play with, since it is an action and motion toy in which the intermittent movement of a limb is accurately simulated. Thus in the exemplary case of a soccer player doll, the child can imagine that he or she is actually playing the game of soccer by performing the main act in such a game, i.e. the kicking of a soccer ball. The mechanism of the doll internals is structure which is readily and cheaply fabricated and assembled. The doll is durable and not easily broken by a child at play, since a relatively simple and strong internal structure is provided. The present motion doll accurately simulates real life movement of a limb. The external detachably attachable trigger means provides a new and durable structure for attaching a motion shaft means to a doll.

The invention accordingly consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is an overall elevation view showing the doll with the associated trigger means spaced therefrom;

FIG. 2 is a sectional plan view of the trigger means taken substantially along the line 2—2 of FIG. 1;

FIG. 3 is a sectional elevation view taken substantially along the line 3—3 of FIG. 2;

FIG. 9 is an overall elevation view of the doll and trigger means showing intermittent motion of a limb, i.e. a kicking action;

FIG. 10 is a sectional plan view taken substantially along the line 10—10 of FIG. 9;

FIG. 11 is a sectional elevation view taken substantially along the line 11—11 of FIG. 10; and FIG. 12 is a sectional elevation view showing the mode of attachment of the limb to the main gear.

DETAILED DESCRIPTION OF THE PREFERRED EMBODIMENTS

Figure 4:
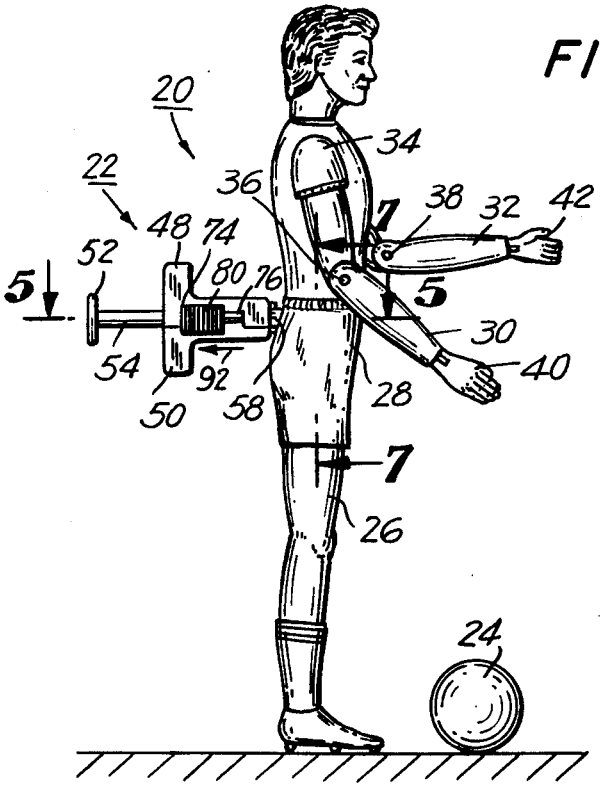
FIG. 4 is an overall elevation view showing the trigger means emplaced in the doll.

Referring now to FIGS. 1, 2 and 3, the present invention in a preferred embodiment includes a doll 20 and a trigger mechanism 22. In this embodiment of the invention the doll simulates a soccer player, and a simulated soccer ball 24 is disposed adjacent a leg 26 of the doll 20. The leg 26 depends from the torso 28 of the doll 20, and in addition the doll 20 is provided with pivoted arms 30 and 32. It will be appreciated that in suitable alternative instances, as in the case of a basketball player rather than a soccer player, one or both of the arms 30 and 32 rather than the leg 26 may be pivotally movable in accordance with the present invention, however in this embodiment of the invention the leg 26 is pivotally movable by the trigger means 22, and the arms 30 and 32 are simply pivoted for manual manipulation at will, i.e. at the shoulder 34 and elbows 36 and 38, by any suitable joint configuration, and the motion of the arms 30 and 32 in this embodiment of the invention does not enter into the present new configuration. The hands 40 and 42 may similarly be provided with wrist joints of a known configuration for manual manipulation.

Thus the trigger means 22 actuates a kicking motion of the leg 26, typically against the ball 24, when the trigger means 22 is emplaced in the torso 28 and manipulated. The trigger means 22, as seen in FIGS. 2 and 3, and prior to emplacement in a direction indicated by arrow 44 (FIG. 1) in an opening in the rear of the torso 28, includes a housing 46 having two opposed rear lateral extensions 48 and 50 so that the trigger means 22 may readily be grasped, especially when the trigger means 22 is emplaced on the doll and the flat circular head 52 of a shaft 54 is pressed to displace the shaft 54 towards the doll 20 in the direction indicated by the arrow 44 so as to initiate the kicking action of the leg 26.

The housing 46 of the trigger means 22 is characterized by the provision of two opposed hook members 56 and 58 on opposite sides of an opening 60 in the housing 46. As will appear infra, the hook members 56 and 58 are provided for the detachable attachment of the trigger means 22 to the doll torso 28. The hook member 56 has an outer lateral lip 62, and this hook member 56 is a rigid member mounted integral to the housing 46. The hook member 58 also has an outer lateral lip 64. In the case of hook member 58, this member 58 is displaceable away from hook member 56 rather than being rigidly mounted to the housing 46. The reason for this is so that the trigger means 22 may be detachably attached to the doll torso 28 by inserting the hooks 56 and 58 in an opening in the hollow torso 28 and displacing hook member 58 away from the hook member 56, so that the lips 62 and 64 are inside the torso 28 and hold the trigger means 22 in place, see FIG. 5.

Hook member 58 is displaceable away from hook member 56 by pivotally attaching hook member 58 at pivot 66 to a resilient lever 68. The lever 68 extends from the pivot 66 to a terminal mounting at its other end 69 below a restraint baffle 70, so that the end 69 of lever 68 below baffle 70 is slidably engaged by baffle 70 and is displaceable. The lever 68 has lateral intermediate shoulder 72. An outer camming button 74 is provided on the housing; the button 74 is provided with side grooves 75 (FIG. 3) so that it is slidably displaceable along open channel or slot 76 in housing 46. The button 74 has a curved inner camming surface 78 for reasons which will appear infra, and outer ridges 80 for easy manipulation by a finger of the child. As seen in FIG. 2, with the button 74 in a fowards orientation the lever 68 is relaxed and is essentially linear. The trigger mechanism 22 is completed by the provision of an inner helical spring 82 which is concentrically mounted about the inner end 84 of shaft 54. The spring means 82 extend between a flange 86 on the shaft 54 and a mounting baffle 88 which is an integral part of housing 46, so that the shaft 54 is urged away from the opening 60 by the spring 82 and the inner end 84 of shaft 54 remains inside the housing 46 unless and until the head 52 is manually pressed and urged towards the housing 46, which is generally accomplished by a child by placing two fingers of one hand over each of the extensions 48 and 50 and pressing the thumb of the hand against the head 52. This is only done in practice after the trigger means 52 has been emplaced on the doll torso 28.

Figure 6:
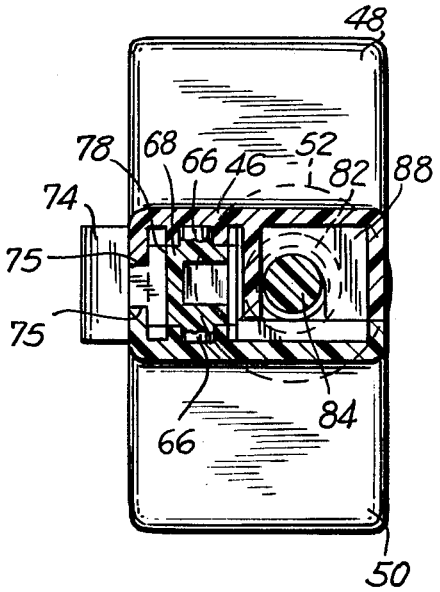
FIG. 6 is a sectional elevation view taken substantially along the line 6—6 of FIG. 5.
Figure 5:
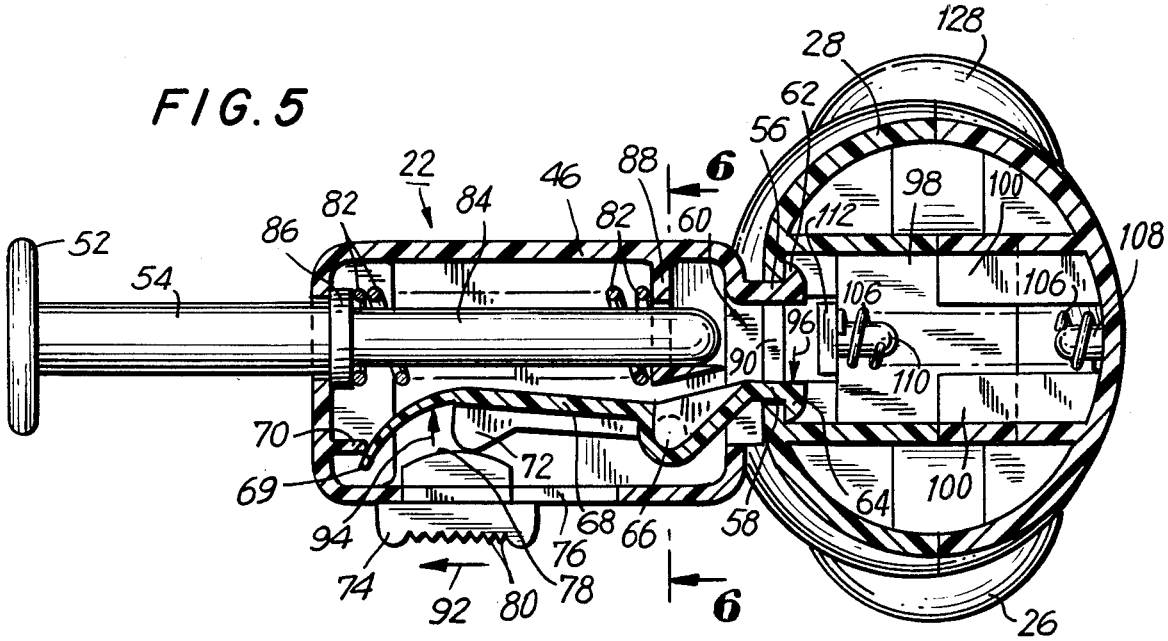
FIG. 5 is a sectional plan view taken substantially along the line 5—5 of FIG. 4.

FIGS. 4, 5 and 6 show the mode of emplacement of the trigger means 22 onto the doll torso 28. The hook members 56 and 58, having previously been inserted into the opening 90 in the torso 28 while the trigger means 22 was in the FIG. 2 orientation, are now fully separated from each other with the lips 62 and 64 within and contiguous with the torso 28. This has been accomplished by manually displacing button 74 along slot 76 to the rear of the trigger means 22, i.e. in the direction shown by arrow 92. As best seen in FIG. 5, the displacement of button 74 away from the hook 58 has cammed the lever 68 in the direction shown by arrow 94 and into an arcuate disposition and under tension, by the camming action of surface 78 against shoulder 72, so that the hook 58 is now displaced in the direction shown by arrow 96 and away from the hook 56, and the housing 46 is locked to the doll torso 28 with the lips 62 and 64 within the opening 90 in the doll torso 28. The lever 68 is held in the arcuate disposition as shown in FIG. 5 by providing the curved camming surface 78 on the interior edge of the button 74. It will be apparent that when the head 52 is pressed by the thumb of a child, the section 84 of the shaft 54 will move towards the torso 28 and will eventually extend through both the opening 60 in the housing 46 and the opening 90 in the doll torso 28, and into the torso 28 itself, as best seen in FIG. 10.

Figure 8:
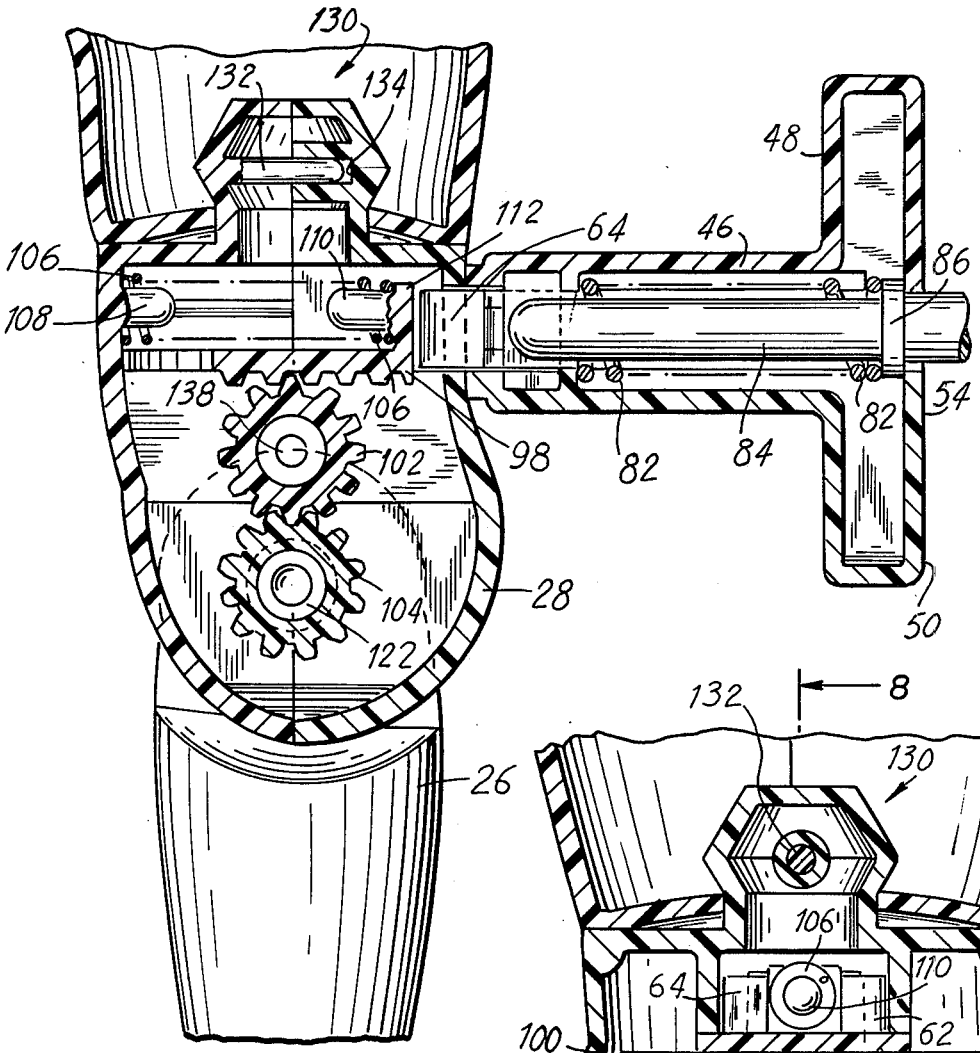
FIG. 8 is a sectional elevation view taken substantially along the line 8—8 of FIG. 7.
Figure 7:
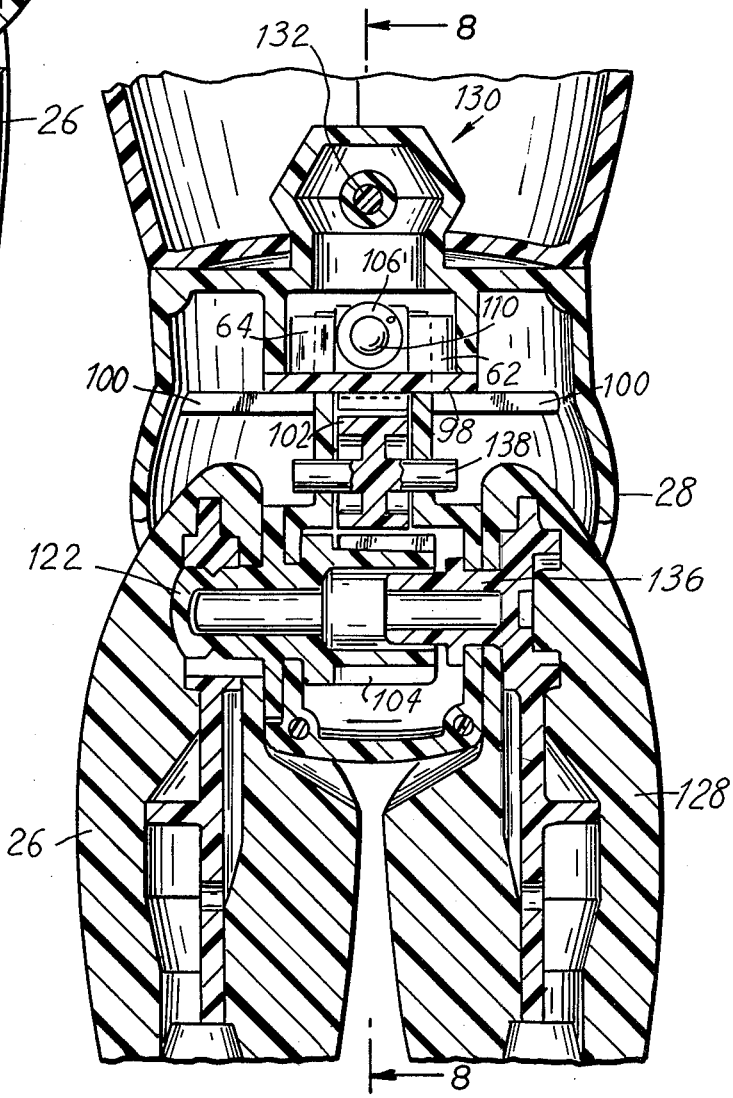
FIG. 7 is sectional elevation view taken substantially along the line 7—7 of FIG. 4.

FIGS. 5, 7 and 8 show the internal configuration of the doll torso 28 prior to the manipulation of the shaft means 54 towards the torso 28; such manipulation accomplishing the extension of shaft section 84 internally into the torso 28 and the kicking action of leg 26, as will appear infra. The torso 28 is characterized by the provision of a movable internal toothed rack 98 slidably mounted on shelves 100, which are an integral part of the torso 28; a pinion gear 102 mounted in the torso 28, and a main gear 104 also mounted in the torso 28. The pinion gear 102 is disposed between the rack 98 and the main gear 104, so that movement of the rack 98 along the shelves 100 serves to rotate the pinion gear 102 which in turn rotates the main gear 104. The rack 98 is biased to a disposition in which the leg 26 tends to depend vertically downwards from the torso 28 by the provision of internal spring means 106. The spring 106 is mounted at one end within the torso 28 on a protuberance 108 which is integral with the torso 28, and the other free and movable end of the spring 106 is mounted on a protuberance 110 which in turn is integrally mounted to a baffle 112 which is integral with one end of the rack 98 and generally perpendicular to the rack 98.

Referring now to FIGS. 9, 10, 11 and 12, the kicking action of leg 26 of the present doll is shown. Manual manipulation consisting of the pressing of head 52 towards the housing 46, as indicated by arrow 114, with the trigger means 22 having been grasped by a child as described supra, moves the shaft means 54 through the housing 46 and towards the torso 28, so that the shaft means section 84 enters the torso 28 through openings 60 and 90 and presses against baffle 112 (arrow 116) so as to move the rack 98 away from the openings 60 and 90 and transversely to the axis of the pinion gear 102 and main gear 104, and to partially rotate pinion gear 102 in the direction indicated by arrow 118 (FIG. 11), which partial rotation serves to partially rotate main gear 104 in the direction indicated by arrow 120. Concomitantly, the springs 82 and 106 become compressed and store potential energy for return motion when the pressure or force indicated by arrow 114 is released. The axle 122 of main gear 104 is provided with a key 124 (FIG. 12) at the end of axle 122 contiguous with the leg 26, which key 124 fits into keyway in the upper end of leg 26, so that the leg 26 is pivoted about its upper end in the direction indicated by arrow 126, and the ball 24 is kicked by the leg 26 (FIG. 9). As indicated supra, the leg 26 will return to a previous position parallel to the other leg 128 when the force indicated by arrow 114 is withdrawn. This return of leg 26 to its prior disposition is indicated by the phantom outline in FIG. 12.

FIGS. 7, 8 and 11 also show details of a joint 130 by means of which the two halves of the doll torso 28 are joined. This joint 130 does not enter into the invention, i.e. any suitable joint or joining means may be provided in practice, however in the interest of full disclosure and to enable practice of the invention by those skilled in the art, the joint 130 has been shown. Essentially joint 130 consists of a shaft 132 integral with one half of the torso, which fits into a socket 134 integral with the other half of the torso. A fitting 136 is also provided to mount the end of main gear 104 opposite to the end juxtaposed with leg 26. This opposite end of main gear 104 does not have an axle but instead has a cylindrical recess to receive member 136. However the pinion gear 102 is of a conventional gear configuration and mounting, being provided with an axle 138 for mounting in the torso 28.

It thus will be seen that there is provided an article of manufacture consisting of a kicking doll which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A doll with an intermittently movable leg, comprising a torso having a front and a back, a hollow interior, and an opening communicating the latter with the exterior of said torso; means for mounting said movable leg on said torso for pivoting between a rest position in which said leg depends from said torso and an elevated position, in a trajectory extending frontwardly and upwardly relative to said torso; a main gear connected to said leg for joint pivoting; a toothed rack mounted in said interior of said torso for movement between a retracted and an extended position; a gear transmission including at least one intermediate gear interposed between and meshing with said rack and said main gear for converting the movement of said rack into the pivoting of said main gear; and means for moving said rack between said positions thereof, including trigger means separate from and detachably connected to said torso and having a housing and a shaft supported in said housing and extending beyond the same and, when said trigger means is connected to said torso, into said interior of the latter through said opening to contact and move said rack upon actuation of said trigger means.

2. The doll of claim 1 in which said moving means further includes resilient means so biasing the rack that when the shaft is spaced away from the rack, the leg returns to its rest position relative to the torso.

3. The doll of claim 2 in which the resilient means is a spring.

4. The doll of claim 1 in which the rack is biased by first spring means and the shaft means is biased in the trigger means by second spring means, so that the shaft means tends to be displaced away from the rack unless manipulated towards the torso, and so that when the shaft means is spaced away from the rack, the limb returns to its former position relative to the torso.

5. A doll with intermittently movable limb comprising a torso provided with an opening, at least a portion of said torso being hollow, at least one limb, said limb extending from said torso, a toothed rack, said rack being mounted within said torso, at least one main gear, said main gear being geared to said rack, the axle of said main gear being connected to said limb at a pivot point, so that when said main gear is partially rotated by motion of said rack transversely to the axis of said main gear, said limb partially pivots about said pivot point, and means to displace said rack within said torso transversely to the axis of said main gear, including shaft means extending internally into the torso through said opening, and trigger means detachably mounting the shaft means to the doll by detachably attaching the trigger means to the doll, the trigger means comprising a housing having two opposed hook members on opposite sides of an opening in said housing, each of said hook members having an outer lateral lip, one of said hook members being a rigid member mounted integral to said housing, the other of said hook members being pivotally attached to a resilient lever having a lateral intermediate shoulder, together with an outer camming button on said housing juxtaposed with said shoulder, so that displacement of said button away from said other hook cams said lever into an arcuate disposition under tension, whereby said other hook is displaced away from said one hook and said housing is locked to the doll with said lips within the opening in the doll, said lever being held in said arcuate disposition by providing a curved camming surface on said button, said shaft means extending through both the opening in the housing and the opening in the doll when said shaft means is manipulated towards and extends internally into the torso.

6. The doll of claim 5 in which an intermediate pinion gear is provided between the main gear and the rack, the main gear being geared to the rack by said intermediate pinion gear, so that motion of the rack in one direction relative to the torso partially rotates said intermediate pinion gear, and the partial rotation of said intermediate pinion gear causes partial rotation of the main gear.

7. The doll of claim 5 in which the limb is a leg of the doll.

8. The doll of claim 5 in which the axle of the main gear is connected to the limb by providing a key at the end of the axle, said axle end fitting into the limb, and a keyway in the limb at the junction between the axle end and the limb, said key extending into said keyway.

* * * * *